US006729049B1

(12) United States Patent
Hui

(10) Patent No.: US 6,729,049 B1
(45) Date of Patent: May 4, 2004

(54) MUD WALKING SHOE

(75) Inventor: Clifford A. Hui, Davis, CA (US)

(73) Assignee: The United States of America as represented by the Department of the Interior, Washington, DC (US)

( * ) Notice: Subject to any disclaimer, the term of this patent is extended or adjusted under 35 U.S.C. 154(b) by 0 days.

(21) Appl. No.: 10/342,658

(22) Filed: Jan. 15, 2003

(51) Int. Cl.[7] ..... A43C 15/02
(52) U.S. Cl. ..... 36/116; 36/7.6
(58) Field of Search ..... 36/122–125, 132, 36/116, 7.6; 172/21, 22

(56) References Cited

U.S. PATENT DOCUMENTS

| | | | | | |
|---|---|---|---|---|---|
| 683,595 | A | | 10/1901 | Drouillard | |
| 1,266,492 | A | | 5/1918 | Kurrell et al. | |
| 1,310,358 | A | * | 7/1919 | Manderfield | 36/7.5 |
| 2,412,474 | A | * | 12/1946 | Scott-Paine et al. | 36/7.5 |
| 2,720,714 | A | * | 10/1955 | Richard et al. | 36/7.5 |
| 2,779,262 | A | * | 1/1957 | Furr et al. | 172/370 |
| 2,825,153 | A | | 3/1958 | Fabrizio | 36/7.5 |
| 3,269,037 | A | * | 8/1966 | Massicotte | 36/124 |
| 3,747,236 | A | | 7/1973 | Sidlauskas | 36/2.5 |
| 4,004,355 | A | * | 1/1977 | Koblick | 36/122 |
| 4,286,397 | A | * | 9/1981 | Booty | 36/132 |
| 4,525,941 | A | | 7/1985 | Ruth, Jr. | 36/116 |
| 4,958,445 | A | * | 9/1990 | Brisco | 36/7.5 |
| 6,006,646 | A | * | 12/1999 | Makris et al. | 36/7.5 |
| 6,421,935 | B1 | * | 7/2002 | Bartlett | 36/132 |
| 6,523,280 | B1 | * | 2/2003 | Lapointe | 36/7.8 |
| 6,655,051 | B1 | * | 12/2003 | Peche et al. | 36/103 |

* cited by examiner

*Primary Examiner*—Ted Kavanaugh
(74) *Attorney, Agent, or Firm*—Mark Homer

(57) ABSTRACT

An apparatus for walking on mud includes a shoe body made of a rigid material that floats in water, the shoe body including a generally horizontal top surface having a substantially greater area than an area of a sole of a foot of a user, the shoe body including a bottom portion having a bottom surface with a generally convex contour; a fastener attached to the top surface for attaching the apparatus to a foot of a user; and pegs attached to the bottom surface, the pegs extending downwardly away from the bottom surface.

14 Claims, 1 Drawing Sheet

MUD WALKING SHOE

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates to an apparatus that attaches to a foot or footwear to enable a person to walk on mud without sinking.

In general, mud shoes allow one to walk on mud that is so fluid that without the mud shoes, one would sink in the mud beyond one's knees. Mud walking shoes are used by those working around wetland areas and expanses of mud such as tidal mud flats or seasonal ponds and lakes. Such persons may be biologists, hyrdrologists, or geologists, for example. Rescue agencies may also use mud walking shoes, for example, in areas such as Alaska where persons have been stuck and died in tidal mud.

Various devices for walking on water or mud are known. U.S. Pat. No. 4,525,941 discloses a mud walker comprising a platform supported around the periphery of its under surface by a pneumatic tube cushion secured to the platform by strap loops. The top side of the platform is equipped with adjustable means of securement to the shoe or boot of the user. Vent holes in mid portions of the platform prevent suction effects under the platform when the foot is lifted. A problem with the pneumatic tube cushion is that it is slippery on the mud surface and the pneumatic aspect imparts a bouncy instability.

U.S. Pat. No. 3,747,236 shows a pair of flotation shoes for walking on water. The flotation shoes are elongated and made of a floatable material, such as polystyrene. Each shoe includes a fin tail and downward extending fins or vanes on the underside. The shoes include means on the top surface for engaging the foot of the user. These shoes are used for water walking, not mud walking.

U.S. Pat. No. 2,825,153 discloses a sandal for walking on tar, asphalt and the like. The sandal includes a frame made of aluminum and a sole made of felt. Attachment means are provided for securing a user's foot to the sandal. The sole is saturated with kerosene to prevent hot tar from sticking to the sole. The shoes are not designed for mud walking.

U.S. Pat. No. 2,412,474 relates to a mud walking shoe that includes a shell with or without a cover. The bottom of the shell includes transversely extending step formations. Inside the shell is means for attaching the shell to a user's foot. Because the user's foot is attached to the bottom of the shell, the construction is somewhat complicated and the chance for mud to enter the shell is increased.

U.S. Pat. No. 1,266,492 discloses a mud shoe comprising a wood frame having interior strips also made of wood or a similar material. A sheet of canvas is attached to the bottom of frame, hanging loosely therefrom. The frame includes means for attaching the frame to a user's foot or shoe. Sidewards slipping is a problem with this device.

U.S. Pat. No. 683,595 shows a marsh shoe comprising a disk of sheet metal provided with leather straps for attaching the disk to a user's boots or the like. In the rear of the heel is an air-pipe which allows air to flow to the mud when lifting the heel portion. This device requires a large horizontal area for buoyancy and, also, is subject to sidewards slipping.

SUMMARY OF THE INVENTION

One embodiment of the present invention is an apparatus for walking on mud comprising a shoe body made of a rigid material that floats in water, the shoe body including a generally horizontal top surface having a substantially greater area than an area of a sole of a foot of a user, the shoe body including a bottom portion having a bottom surface with a generally convex contour; a fastener attached to the top surface for attaching the apparatus to a foot of a user; and pegs attached to the bottom surface, the pegs extending downwardly away from the bottom surface.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention enables one to walk on the surface of very fluid mud. The inventive mud shoes prevent the user from sinking, eliminate sideslip when shifting weight (as when taking a step) on the mud and promote release when lifting the mud shoe from the mud. Sinking is inhibited by a horizontal surface area over which to distribute weight and a construction comprising primarily a rigid material that floats in water. Buoyancy increases as the mud shoe settles into the mud. Sideslip is eliminated by a plurality of pegs extending from the bottom of the mud shoe. Release from mud is promoted by a front-to-rear convex curvature of the bottom surface. By lifting the mud shoe from the heel first as in normal walking motion, the mud shoe bottom is similar to a wheel rolling over the mud and no suction by the mud occurs as in the case with a flat-bottomed surface. A fastener, such as adjustable straps, secure the user's barefoot, sandals, boots, waders, etc. to the mud shoe.

Figure 1:
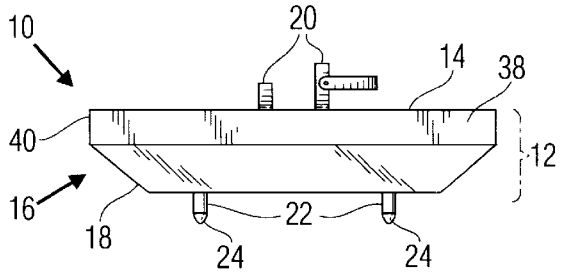
FIG. 1 is a side view of one embodiment of a mud shoe according to the invention.

FIG. 1 is a side view of one embodiment of a mud shoe 10 according to the invention. Mud shoe 10 includes a shoe body 12 made of a rigid material that floats in water. The rigid material is preferably a plastic material, as plastic is easily molded. The shoe body 12 includes a generally horizontal top surface 14 having a substantially greater area than the area of the sole of the foot of a user. Different sized horizontal surface areas may be used. A smaller size makes walking easier and may be sufficient for users with light body weights and/or walking over mud that is less fluid. More horizontal surface area is necessary for heavier persons and mud with greater fluidity.

Figure 3:
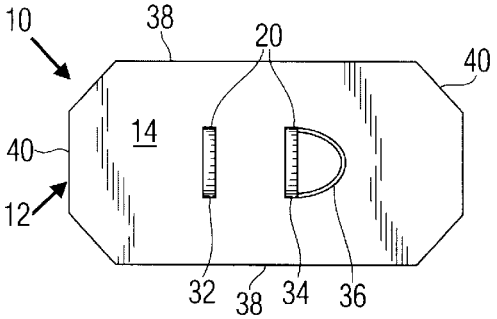
FIG. 3 is a top view of the embodiment of FIG. 1.

The shoe body 12 includes a bottom portion 16 having a bottom surface 18 with a generally front-to-rear convex contour. The bottom portion 16 includes ends 40 and sides 38 that are generally perpendicular to the top surface 14. A fastener 20 is attached to the top surface 14 for attaching the mud shoe 10 to the barefoot or footwear of the user. Fastener 20 may comprise, for example, adjustable straps, such as a toe strap 32, an arch strap 34 and a heel strap 36 (FIG. 3). Adjustable straps 32, 34 and 36 may include buckles or hook and loop fasteners.

Pegs 22 are attached to the bottom surface 18 of the mud shoe. The pegs 22 extend downwardly away from the bottom surface 18. Pegs 22 act as spikes into the fluid mud and stop horizontal motion. The pegs 22 are preferably beveled at their ends 24. The beveled ends 24 help in lifting the pegs from the mud. In a preferred embodiment, four pegs 22 are used. By way of example, pegs 22 are about one inch in diameter to inhibit fluid flow. The pegs 22 help to eliminate sideslip. Pegs 22 may also be made of plastic and molded integral with the shoe body 12. Pegs 22 are preferably about two inches in length to penetrate through the fluid boundary layer of mud adjacent the mud shoe. Other lengths may also be used. The pegs 22 also allow the mud shoe to be used on a hard surface, while maintaining stability. More than four pegs 22 may be used.

Figure 2:
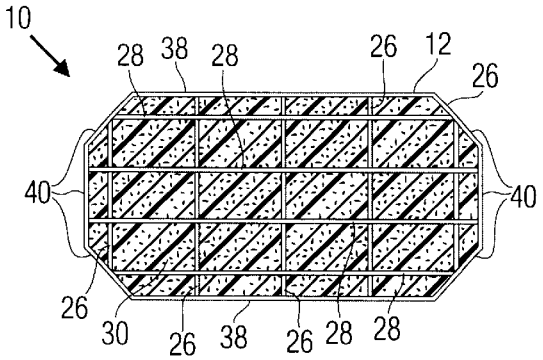
FIG. 2 is a top view of the embodiment of FIG. 1, with the top surface removed.

As shown in FIG. 2, the interior of the shoe body 12 may include support members 26, 28 for supporting the top surface 14. Only longitudinal support members 28 may be used. Only transverse support members 26 may be used, or a combination of longitudinal and transverse support members 28,26 may be used. Rather than using support members 28, 26, the interior of the shoe body 12 may be filled with foam 30, such as a rigid closed-cell foam, for example polystyrene. Alternatively, the foam 30 may used in conjunction with the longitudinal support members 28, the transverse support members 26 or a combination of both types of support members.

Figure 4:
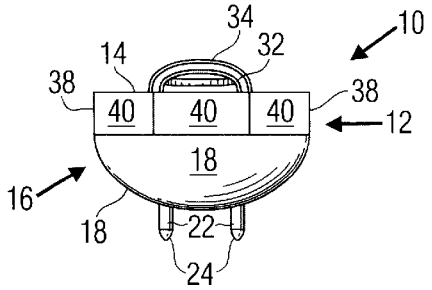
FIG. 4 is an end view of the embodiment of FIG. 1.
Figure 5:
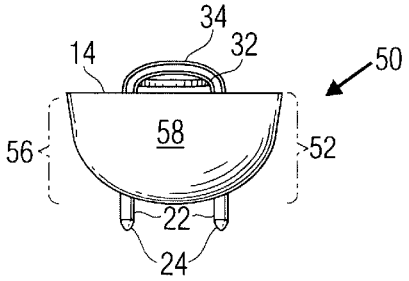
FIG. 5 is an end view of another embodiment of a mud shoe according to the invention.

FIG. 4 is an end view of the embodiment 10 of FIG. 1 showing the ends 40 generally perpendicular to the top surface 14. An alternative embodiment of a mud shoe 50 is shown in end view in FIG. 5. Mud shoe 50 includes a shoe body 52 having a bottom portion 56. Bottom portion 56 includes a bottom surface 58 with a generally convex contour. The bottom surface 58 curves away from the top surface 14 and does not include the side and end surfaces of the embodiment of FIGS. 1–4.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for walking on mud, comprising:

a shoe body made of a rigid material that floats in water, the shoe body including a generally horizontal top surface having a substantially greater area than an area of a sole of a foot of a user, the shoe body including a bottom portion having a bottom surface with a generally convex contour;

a fastener attached to the top surface for attaching the apparatus to a foot of a user; and pegs attached to the bottom surface, the pegs extending downwardly away from the bottom surface.

2. The apparatus of claim 1 wherein the bottom portion includes ends and sides generally perpendicular to the top surface.

3. The apparatus of claim 1 wherein a diameter of the pegs is at least about one inch.

4. The apparatus of claim 1 wherein a length of the pegs is about two inches.

5. The apparatus of claim 1 wherein a number of the pegs is four.

6. The apparatus of claim 1 wherein ends of the pegs are beveled.

7. The apparatus of claim 1 wherein an interior of the shoe body includes support members for supporting the top surface.

8. The apparatus of claim 7 wherein the support members are longitudinal support members.

9. The apparatus of claim 7 wherein the support members are transverse support members.

10. he apparatus of claim 7 wherein an interior of the shoe body includes foam.

11. The apparatus of claim 1 wherein an interior of the shoe body includes foam.

12. The apparatus of claim 1 wherein the fastener comprises straps.

13. The apparatus of claim 12 wherein the straps comprise a toe strap, an arch strap and a heel strap.

14. The apparatus of claim 1 wherein the bottom portion curves away from the top surface.

* * * * *